United States Patent [19]

Widemann et al.

[11] Patent Number: 4,678,431

[45] Date of Patent: Jul. 7, 1987

[54] VAPORIZATION BURNER FOR A HEATER OPERATED BY MEANS OF LIQUID FUEL

[75] Inventors: Friedrich Widemann, Munich; Dieter Goerlich, Emmering, both of Fed. Rep. of Germany

[73] Assignee: Webasto-Werk W. Baier GmbH & Co, Fed. Rep. of Germany

[21] Appl. No.: 826,813

[22] Filed: Feb. 6, 1986

[30] Foreign Application Priority Data

Feb. 8, 1985 [DE] Fed. Rep. of Germany ..... 3504291
Oct. 26, 1985 [DE] Fed. Rep. of Germany ..... 3538201

[51] Int. Cl.[4] ..... F23B 3/40

[52] U.S. Cl. ..... 431/328; 431/326; 126/95; 126/116 R

[58] Field of Search ..... 431/326, 328, 329, 331, 431/333; 126/95, 116 R, 59.5

[56] References Cited

U.S. PATENT DOCUMENTS

| | | | |
|---|---|---|---|
| 1,259,029 | 3/1918 | Lucke | 431/329 |
| 3,159,201 | 12/1964 | Hottenroth et al. | 431/329 X |
| 4,530,658 | 7/1985 | Panick | 431/329 |

*Primary Examiner*—Samuel Scott
*Assistant Examiner*—Allen J. Flanigan

[57] ABSTRACT

For a heater operated by means of liquid fuel, a vaporization burner is provided that has a large-volume active first vaporization part for the very volatile components of the fuel and a large-surface second vaporization part for the least volatile fuel components. The two vaporization parts are separated from one another by a fuel-impermeable material, such as ceramics, so that any occurring coke formations at the second passive vaporization part cannot migrate to the first vaporization part. As a result, the operating reliability and the service life of such a vaporization burner are improved.

20 Claims, 4 Drawing Figures

VAPORIZATION BURNER FOR A HEATER OPERATED BY MEANS OF LIQUID FUEL

BACKGROUND OF THE INVENTION

This invention relates to a vaporization burner for a heater operated by means of liquid fuel that especially is intended to be used as a vehicle heater or an auxiliary vehicle heater.

On the basis of German Offenlegungschrift No. 32 33 321 and corresponding U.S. Pat. No. 4,530,658, a vaporization burner of the initially mentioned type is known that has an absorbent body projecting into a combusiton chamber of the heater which is supplied with fuel via a fuel feeding device. It has been found that such vaporization burners are sensitive to temperature and to bubbles in the fuel fed via the fuel feeding device. In particular, the service life of such a vaporization burner is reduced by the fact that deposits of coke accumulate, during the operation of the heater, on the absorbent body. The absorbent body is formed, for example, by a fleece, and the coke deposits increase, as a function of time, in a direction toward the area where the fuel enters into the absorbent body. These coke deposits, which spread in a direction toward the fuel entrance, will gradually block the fuel supply so that the heater may break down.

The invention, therefore, has a primary object of overcoming the above-mentioned difficulties and, particularly to provide a vaporization burner of the type mentioned which is not only less sensitive to temperature and bubbles for a better operability of the burner, but especially, also has a longer service life.

According to the invention, a vaporization burner is provided that is advantageous because of the fact that the absorbent body has a first vaporization part for the very volatile fuel components and a second vaporization part for the least volatile fuel components. The fuel feeding device, in this case, leads into the first vaporization part and the second vaporization part faces the combusion chamber of the heater and is separated from the first vaporization part by a material that is impermeable with respect to fuel.

The first vaporization part for the very volatile fuel components, in this case, forms the active part of the vaporization burner, whereas the second vaporization part for the least volatile fuel components forms a passive part of the vaporization burner. When, preferably, the first or active vaporization part is arranged at least partially in the shadow of a glow type ignitor, such as a glow plug, a secure ignition can be ensured and the heat load from the combustion chamber to the active part formed by the first vaporization part is reduced so that a longer service life is obtained. By means of this division of the absorbent body into two parts, provided according to the invention, the sensitivity to temperature and to bubbles of such a vaporization burner is significantly reduced.

Since the least volatile fuel components vaporize at the second vaporization part, erosion phenomena, such as the formation of coke, occurs at the surface of this passive part of the absorbent body but do not impair the function of the active first vaporization part. That is, the erosion and formation of coke are restricted to the second passive vaporization part because the coke is formed by the residues of the less volatile fuel components and it is prevented from spreading to the active vaporization part by the separation that is impermeable with respect to fuel. Furthermore, because the fuel feeding device in the case of the invention leads into the first active vaporization part, a clogging and blocking of the fuel entering area is also effectively prevented so that the operability of the vaporization burner as a whole is maintained longer.

In a further development of the invention, the first vaporization part is smaller in its diameter than the second vaporization part; the axial dimension of the first vaporization part is larger than the axial dimension of the second vaporization part; and the first vaporization part is arranged eccentrically with respect to the center line of the combustion chamber in a direction bringing it closer to glow plug. In the case of such an embodiment of the vaporization burner as the preferred further development according to the invention, a large-volume first vaporization part is obtained having a small area surface that is very active in regard to the vaporization of the very volatile components and which, on the basis of its large absorbing volume, also reduces the sensitivity to bubbles. The passive second vaporization part, on the other hand, has a large area surface that faces the combustion chamber of the heater in order to ensure the operational capability also in the case of erosion (coke formation). Preferably the diameter of the first vaporization part is about half as large as the diameter of the second vaporization part, and the axial dimension of the second vaporization part is about one fourth of the axial dimension of the first vaporization part.

In order to prevent a dripping of the least volatile fuel particles from the outer circumference of the first active vaporization part, and in order to achieve the separation of the first and the second vaporization part at the end of the absorbent body that faces the combustion chamber, the first vaporization part is surrounded by a body that is impermeable with respect to fuel and is preferably developed in the shape of a hollow cylinder approximating the shape of a pipe segment. The part of the fuel containing the least volatile fuel components and that was not vaporized at the active first vaporization part passes along the inside wall of the fuel impermeable body, that faces the first vaporization part, and then over the free end thereof to the second vaporization part, where it can be absorbed and then vaporize.

Advantageously, a body that is impermeable to fuel is also provided at the side of the second vaporization part that faces away from the combustion chamber, said body forming the rear wall of the second vaporization part that faces away from the combustion chamber. This body that is impermeable to fuel, as the rear wall of the second vaporization part, stops the erosion of the second passive vaporization part so that the coke formation and the erosion are restricted to the passive second vaporization part.

Both bodies that are impermeable to fuel may be made of the same material, such as a ceramic material, and in order to simplify manufacturing, these two bodies that are impermeable to fuel may be formed of one piece.

According to another advantageous development of the invention, the first vaporization part is fastened in or at a burner part containing the fuel feeding device, such as a cover closing the combustion chamber, and a single fuel impermeable body carries both the first vaporization part and the second vaporization part. In this case a distance may exist between the burner part at which the first vaporization part is fastened and the second vaporization part in an axial direction, or the fuel-impermeable body forming the rear wall of the second vaporization part extends in an axial direction without any clearance between it and the burner part. In the case of this type of design, the two vaporization parts and the burner part containing the fuel feeding device form a unit that can be handled jointly in order to, for example, make possible a fast exchange of the vaporization burner as a whole.

In order to obtain a surface for the passive second vaporization part that is as large as possible, the second vaporization part has an outside diameter that is slightly smaller than the diameter of the combustion chamber, namely in such a way that it can be inserted into the combustion chamber without difficulty.

Preferably, the two vaporization parts of the absorbent body are formed of layers of fleece which, as a function of the respective existing conditions and requirements, in regard to their characteristics can be mutually adapted to one another.

According to another advantageous design according to the invention, the two fuel-impermeable bodies are constructed in one piece with the cover of the burner and are made, preferably, completely from a ceramic material, thus, simplifying the manufacturing and mounting of the vaporization burner, because assembling work is not required. In order to give the ceramic material of the cover a thickness that is as narrow as possible and in order to, as far as possible, avoid a processing of the ceramic body, the fuel supply connection piece is lead along the outside wall of the cover and is fastened there, for example, by gluing or a similar process. A bore is provided in the cover that leads into the first absorbent body of the vaporization burner and into which the end of the mouth of the fuel supply connection piece is inserted.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
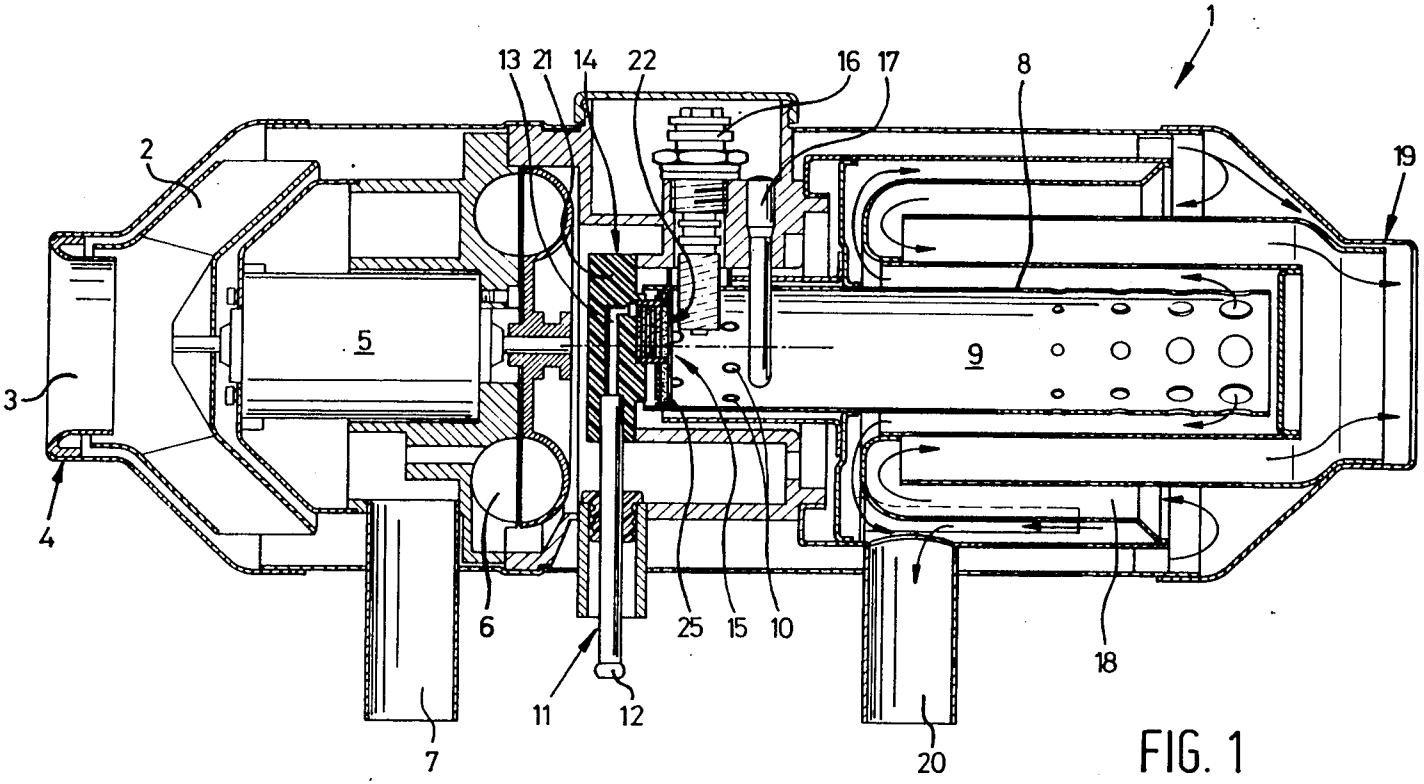
FIG. 1 is a diagrammatic longitudinal sectional view of a heater having a vaporization burner according to the invention.

FIG. 1 shows a heater operated with liquid fuel, that, as a whole, has the reference number 1. In this case, heating air is sucked in by a heating air fan 2, via an inlet 3 at one end 4 of the heater 1. The heating air fan 2 is driven by an electric motor 5 which also drives a lateral duct fan 6 for the combustion air supply. The lateral duct fan 6, via an inlet 7, sucks in air and transports this air into a combustion chamber 9, formed by a burner pipe 8, via slots 10. Via a fuel feeding device 11, which is formed by a fuel supply connection piece 12 and a duct 13 in a burner part 14, fuel is fed to a vaporization burner which, as a whole, has the reference number 15, at which the fuel is vaporized and mixed with the combustion air in the combustion chamber 9. The thus formed mixture, when the heater 1 is started, is ignited by means of an ignition device 16 which is formed, for example, by a glow plug. For the monitoring of the flame, a flame monitor 17 projects into the combustion chambe. The hot combustion gases formed during the combustion in the combustion chamber 9 are led from the combustion chamber 9 into a heat exchanger 18 and, via the heat exchanger 18, supply their heat to the heating air devlivered by the heating air fan 2. The thus heated air leaves the heater 1 at the right-hand end 19 of the heater 1. After passing through the heat exchanger 18, the combustion gases leave the heater 1 via an exhaust gas outlet 20.

Figure 2:
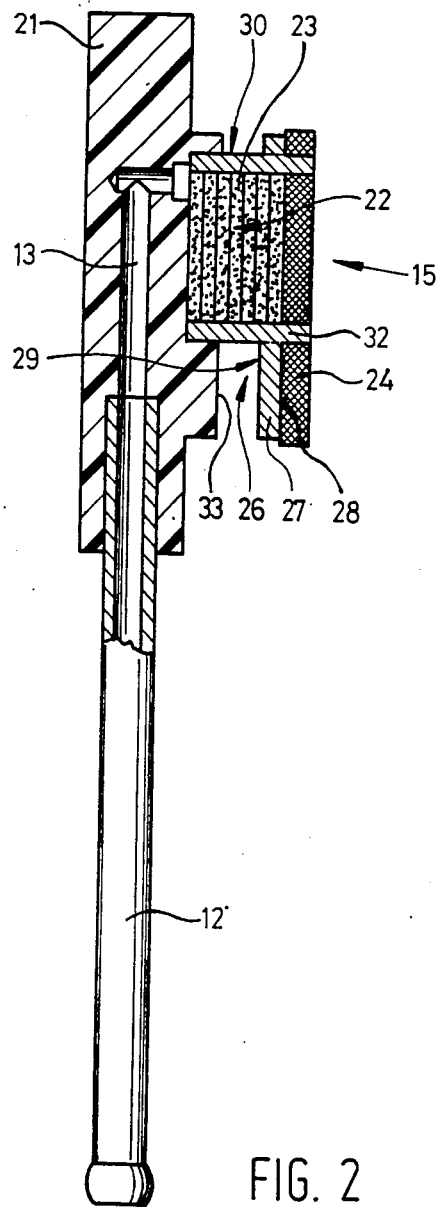
FIG. 2 is an enlarged sectional view of a unit consisting of the burner part containing a fuel feeding device and two vaporization parts of the vaporization burner according to the invention.

As FIG. 1 shows in conjunction with FIG. 2, the vaporization burner 15 is carried by the burner part 14 which at the same time forms a removable cover 21 that may, for example, consist of bakelite or a similar material. The fuel supply connection piece 12, in this case, is inserted into the cover 21 and the duct 13 formed in the cover 21 leads into an absorbent body 22 of the vaporization burner 15.

The absorbent body 22 comprises a first vaporization part 23 for the very volatile fuel components into which the duct 13 of the fuel supply feeding device 11 leads. In addition, the absorbent body 22 also has a second vaporization part 24 for the least volatile fuel components which is arranged at that end of the absorbent body 22 that faces the combustion chamber 9. At 25, a support is shown for the absorbent body 22 in the burner pipe 8.

As shown by full lines in FIG. 2, a body that has the reference number 26 and is impermeable with respect to fuel is provided that is formed, preferably of a ceramic material and surrounds the first vaporization part 23. This fuel impermeable body 26, on the rear side of the second vaporization part 24 (i.e., the side facing away from the combustion chamber 9), has a flange-type radial extension 27 which forms a rear wall 28 of the second vaporization part 24. This flange-type extension 27 forms a fuel-impermeable body 29 for the second vaporization part 24. The fuel-impermeable body 30 associated with the first vaporization part 23 surrounds the first vaporization part 23 and is developed in the shape of a hollow cylinder in the shape of a pipe segment 32. In the case of the embodiment shown by full lines in FIG. 2, both fuel-impermeable bodies 29 and 30 form a unit.

A variant of the embodiment is shown by interrupted lines in FIG. 2, where the fuel-impermeable body 29 of the second vaporization part 24 is developed in the shape of a disk which is fastened on a separate part formed by a pipe segment 32, said part forming the fuel-impermeable body 30 of the first vaporization part 23.

As shown in FIG. 2, the first vaporization part 23 has a smaller diameter than the second vaporization part 24, and the first vaporization part 23 is arranged eccentrically with respect to the central plane of the combustion chamber 9 indicated by a dash-dotted line. The axial dimension of the first vaporization part 23 is also larger than the axial dimension of the second vaporization part 24. Thus, the first vaporization part 23 is developed to have a large volume and a small area surface so that this first vaporization part 23 can be utilized very actively for the vaporization of the very volatile components of the fuel. By means of the large absorbing volume of the first vaporization part 23, the sensitivity to bubbles is reduced. The second vaporization part 24, in comparison to the first vaporization part 23, is the passive part and has a large surface facing the combustion chamber 9 of the heater. In this second evaporation part 24, erosions and unavoidable formation of coke from the residues of the less volatile components occur which, however, cannot spread to the first evaporation part 23 because the first evaporation part 23 is surrounded by the fuel-impermeable body 30 and is thus largely insulated with respect to the passive second vaporization part 24.

The vaporization burner 15 according to the invention operates in the way described in the following. The fuel, that is fed via the fuel feeding device 11 and the duct 13, enters the active first vaporization part 23. The very volatile components of the fed fuel are vaporized at the first vaporization part 23. That part of the fed fuel containing the least volatile components collects in the vicinity of the fuel-impermeable body 30 of the first vaporization part 23 and flows along it and over the free end of pipe segment 32 to the second passibe vaporization part 24 where the least volatile components will then vaporize. By means of the fuel-impermeable body 29 of the second vaporization part 24, the erosion of the second passive vaporization part 24 is stopped, confining coke formed to the second part and also, the second vaporization part 24 is supported at the same time.

As shown in FIG. 2, the first vaporization part 23 is surrounded by the fuel-impermeable body 30, is inserted into the burner part 14 formed by the cover 21 and is fastened there. Thus the two vaporization parts 23 and 24 of the vaporization burner 15 form a unit with the burner part 14 serving as the cover 21 and containing the fuel feeding device 11. If required, this unit, as a whole, can be exchanged rapidly and easily. Since the support 25 is firmly connected with the burner pipe 8, it is also at the same time used as a stop and guide when a corresponding new unit is inserted.

Figure 3:
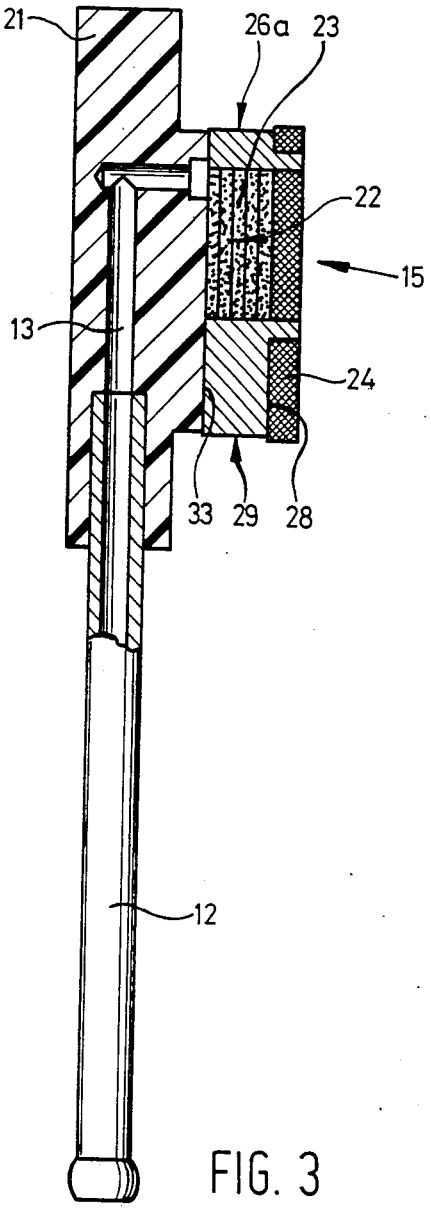
FIG. 3 is a view that is similar to FIG. 2 of a modified embodiment of the vaporization burner.

In the case of the variant of the vaporization burner 15 shown in FIG. 3, in comparison to that of FIG. 2, no space exists between the rear wall 28 formed by the fuel-impermeable body 29 of the second vaporization part 24 and the opposite wall of the cover 21, but the fuel-impermeable body which as a whole has the reference number **26*a* in FIG. 2 extends up to this wall 33 of the cover 21. The fuel-impermeable body 26*a* is fastened at this wall 33, for example, by means of a glue and supports the two vaporization parts 23 and 24 of the vaporization burner 15**.

As shown by FIGS. 1 to 3, the two vaporization parts 23, 24 of the absorbent body 22 can be formed by layers of fleece which, as a function of the respective existing circumstances and requirements, with respect to their characteristics and numbers, can be mutually adapted to one another. The number of the layers of fleece of the respective vaporization parts 23 and 24 and/or thickness of the respective layers of fleece may be selected in various ways. Furthermore, as the outer layer of both vaporization parts are directly subject to the flame, these outer layers should have similar properties, at least with respect to heat resistance, and may be the same material, as shown.

In the case of a practical application of the vaporization burner 15 according to the invention, it was found to be advantgeous for the first vaporization part 23 to have a diameter that is about half the size of the diameter of the second vaporization part 24. In addition, the axial dimension of the second vaporization part 24 is about one fourth of the axial dimension of the first vaporization part 23.

Figure 4:
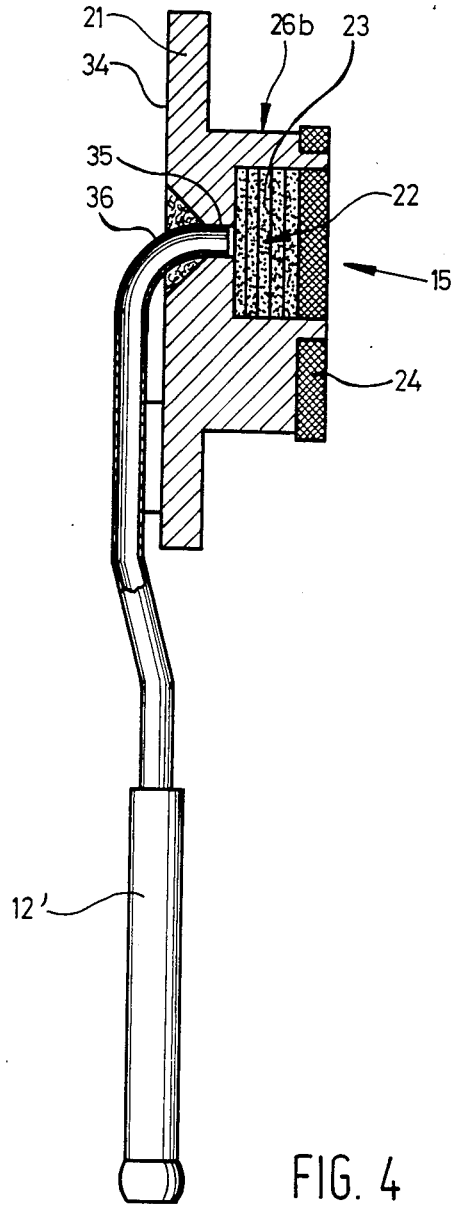
FIG. 4 is a sectional view of another embodiment of vaporization burner.

FIG. 4 shows another variant of a vaporization burner 15 where, as a further development of FIG. 3, the cover 21 forms a part of a one-piece fuel-impermeable body **26*b* that contains both of the first and second vaporization parts 23, 24 of the absorbed body 22**.

The fuel supply connection piece 12' is led along the rear side 34 of the cover part 21 and there is preferably fixed there by gluing and/or form-fitting. The end 36 of the mouth of the fuel supply connection piece that is developed to be bent, is inserted into an axial extending bore 35 of the fuel-impermeable body **26*b*, in which case the bore 35 leads into the absorbent body 22**, as occurs, in a similar way, in the preceding embodiments.

The term "fuel-impermeable" in the case of the invention means that this material essentially lets through no fuel, i.e., absorbs as little as possible, in which case, however, for practical considerations and reasons of cost comprises are possible in this case, provided that it results in a separation of the active and the passive vaporization part.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A vaporization burner for a heater operated by means of liquid fuel, particularly, a heater for vehicles, having an absorbent body to which fuel is supplied via fuel feeding device and which projects into a combustion chamber of the heater, wherein the absorbent body comprises a first vaporization part for very volatile fuel components and into which the fuel feeding device leads, and a second vaporization part for the least volatile fuel components located at an end of the absorbent body facing the combustion chamber, the two vaporization parts being separated from one another in an essentially fuel-impermeable way.

2. A vaporization burner according to claim 1, wherein the first vaporization part has a smaller diameter than the second vaporization part.

3. A vaporization burner according to claim 1, wherein the first vaporization part is arranged eccentrically with respect to a central plane of the combustion chamber.

4. A vaporization burner according to claim 1, wherein the first vaporization part is axially larger than the second vaporization part.

5. A vaporization burner according to claim 2, wherein the first vaporization part has a diameter that is about half the size of the diameter of the second vaporization part.

6. A vaporization burner according to claim 4, wherein the axial dimension of the second vaporization part is about one fourth of the axial dimension of the first vaporization part.

7. A vaporization burner according to claim 1, wherein the fuel-impermeable separation of the first and the second vaporization part comprises a fuel-impermeable body surrouding the first vaporization part.

8. A vaporization burner according to claim 7, wherein a fuel-impermeable body is disposed on a side of the second vaporization part facing away from the combustion chamber.

9. A vaporization burner according to claim 8, wherein the two fuel-impermeable bodies are portions of one piece.

10. A vaporization burner according to claim 1, wherein the first vaporization part is mounted at a burner part containing the fuel feeding device.

11. A vaporization burner according to claim 10, wherein a space exists in an axial direction between the second vaporization part and the burner part containing the fuel feeding device.

12. A vaporization burner according to claim 1, wherein the diameter of the second vaporization part is slightly smaller than that of the combustion chamber.

13. A vaporization burner according to claim 9, wherein the first vaporization unit and the second vaporization part are combined into a unit together with the burner part containing the fuel feeding device.

14. A vaporization burner according to claim 7, wherein the fuel-impermeable body surrounding the first vaporization part is a hollow-cylinder in the shape of a pipe segment.

15. A vaporization burner according to claim 8, wherein the fuel-impermeable body of the second vaporization part is disk-shaped and forms a rear wall facing away from the combustion chamber.

16. A vaporization burner according to claim 7, wherein the fuel-impermeable bodies are formed of ceramic material.

17. A vaporization burner according to claim 1, wherein the vaporization parts are formed by layers of fleece.

18. A vaporization burner according to claim 7, wherein the two fuel-impermeable bodies form a unit with a cover of the burner and are formed in one piece.

19. A vaporization burner according to claim 18, wherein a fuel supply connecting piece of the fuel feeding device is fastened on the rear side of the cover.

20. A vaporization burner according to claim 19, wherein the fuel supply connecting piece penetrates the unit to the absorbent body of the first vaporization part.

* * * * *